United States Patent [19]

Ensmenger

[11] Patent Number: 4,570,926

[45] Date of Patent: Feb. 18, 1986

[54] TOE-ARTICULATED STILT

[76] Inventor: Gary Ensmenger, 307 N. 9th, Apt. #1, Broken Arrow, Okla. 74012

[21] Appl. No.: 521,646

[22] Filed: Aug. 9, 1983

[51] Int. Cl.[4] ..... A63B 23/04; A63B 25/00

[52] U.S. Cl. ..... 272/70.1; 272/70; 272/114; 623/32

[58] Field of Search ..... 272/70, 70.1, 70.2, 272/114; 36/1, 33, 81; 3/15, 16, 4, 5; 128/80 R, 80 G; 135/68

[56] References Cited

U.S. PATENT DOCUMENTS

| | | | |
|---|---|---|---|
| 493,663 | 3/1893 | Steuart | 36/81 |
| 2,517,472 | 8/1950 | Fathauer | 36/33 X |
| 4,449,256 | 5/1984 | Prueitt | 272/114 X |

*Primary Examiner*—Richard J. Apley
*Assistant Examiner*—Kathleen J. D'Arrigo
*Attorney, Agent, or Firm*—Eric P. Schellin

[57] ABSTRACT

A toe-articulated stilt is described wherein there are three support columns and eight hinges to allow a two piece foot support to control a two piece plate which contacts the ground. Natural feel and lightness allow the wearer to dance and do acrobatics on the toe-articulated stilt.

13 Claims, 9 Drawing Figures

TOE-ARTICULATED STILT

FIELD OF THE INVENTION

This invention relates to stilts used in orchard work, entertainment, painting, plastering and other work where height and mobility are required and which can also be used for orthopedic correction and athletics.

BACKGROUND OF THE INVENTION

Crude stilts have been used for hundreds of years. The stilts used in current application by orchard workers, painters and plasterers are still crude because of a number of misconceptions of the best design goals. U.S. Pat. No. 568,557 to Avery and U.S. Pat. No. 2,292,074 to Hawk are examples of the misconception that a very broad base is desirable for stability and safety. U.S. Pat. Nos. 2,802,217 to Wilhoyte, 3,058,120 to Smith, 3,346,882 to Wilhoyte and 3,902,199 to Emmert illustrate the misconception that articulated stilts require springs for natural feel and safe function. U.S. Pat. Nos. 76,465 to Jordan and 1,613,535 to Root illustrate the misconception that curved members can be used and still retain strength.

This invention teaches that lightness, strength and natural feel can be combined to produce stilts on which one can dance, do acrobatics and work long hours without fatigue. A wide base is clumsy and self defeating. Elaborate mechanisms with springs add needless weight. Curved members cause loss of strength which loss must be compensated for with larger, heavier members. All examples of the prior art are too heavy, too clumsy and unnatural in feel leading to fatigue and discouragement of the wearer.

SUMMARY OF THE INVENTION

The aim of this invention is to describe a lightweight, safe, strong stilt which has a natural feel allowing the user to work long hours on stilts without fatigue and which can be used as an orthopedic correction device.

This goal is accomplished by keeping the vertical supports straight so that such members can be as light as possible. The footholder is made articulated in two pieces and the base is similarly articulated in two pieces. The vertical supports are arranged in three columns so that the motion of the articulated footholder is transmitted to the base, the base thereby following the motion of the foot and leg and imparting a natural feel. The base is no larger than the print of the foot of the wearer thereby transmitting a natural feel to the wearer except in special applications on marshy ground where a larger groundplate is necessary. Indeed a base narrower than the foot used on a hard surface allows a trained user more freedom to dance and do athletic feats.

Tests have shown the superiority of the toe-articulated stilt in transmitting a natural feel to the wearer. The toe-articulated stilt is the most orthopedically correct design, leading to less muscle fatigue and higher confidence of the wearer in his safety and security on these stilts. The improved control and self-confidence achieved in turn leads the wearer to attempt feats which have been heretofore impossible on stilts such as dancing, athletics etc. Due to the increased control fewer injuries will result.

The toe-articulated stilt can be manufactured in different models for different purposes. Safe inexpensive models can be made as toys. Highly customized models can be used as therapeutic devices for the disabled.

Light duty models can be made for athletics and fishing. Occupational models can be made for painters, window washers, plasterers, dancers, public speakers, police crowd control and agricultural work.

There is particular potential for the toe-articulated stilt in orchard work. The use of ladders and conventional stilts is tiring, time consuming, dangerous and limiting in ability to reach the center of the tree. Tests have shown that use of the toe-articulated stilt can result in fruit picking which progresses at three to five times the rate of conventional techniques and pruning can progress at ten times the rate of conventional technique.

Limited tests have shown that the same runner can run faster on toe-articulated stilts than without. This indicates a potential for a new sport, stilt racing.

These and further constructional and operational characteristics of the invention will be evident from the detailed description given hereinafter with reference to the figures of the accompanying drawings which illustrate preferred embodiments and alternatives by way of non-limiting examples.

DESCRIPTION OF THE PREFERRED EMBODIMENT

Figure 1:
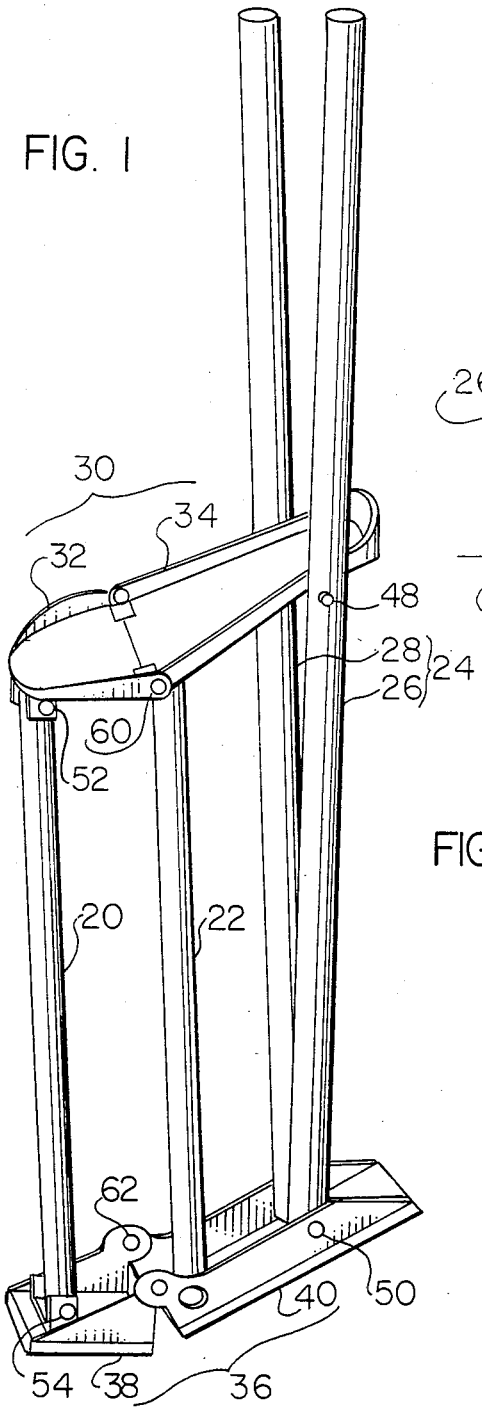
FIG. 1 shows a quarter-front view of the preferred embodiment without the leg and foot attaching devices.
Figure 2:
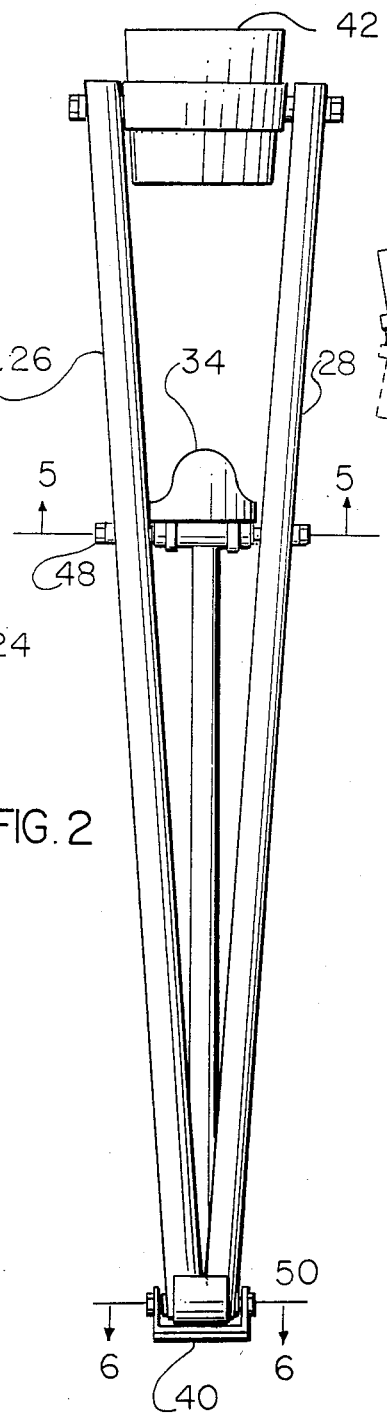
FIG. 2 shows an elevation of the preferred embodiment viewed from the rear showing the V-shape of the two rear supporting members.
Figure 3:
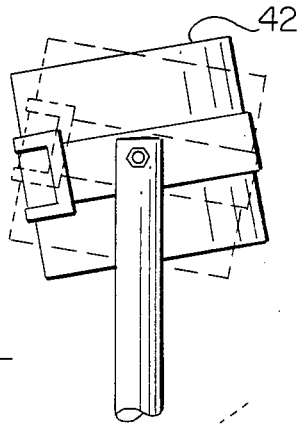
FIG. 3 shows a view from the side of the pivoting action of the calf collar.
Figure 4:
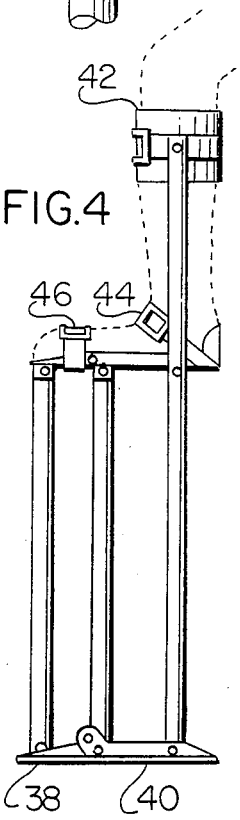
FIG. 4 shows one embodiment of the fastenings for the foot and calf of the wearer illustrating the rotation of the fastening.

Referring now to the drawing wherein reference numerals are used to designate parts throughout the various figures thereof, there is shown in FIG. 1 the preferred embodiment of the toe-articulated stilt. There are three support columns, the toecolumn 20, the solecolumn 22, and the heelcolumn 24. The heelcolumn can be in two parts as shown, a left heelcolumn 26 and a right heelcolumn 28 which together make up the heelcolumn 24. The heelcolumn 24 may be in one part as discussed below. The footholder 30 is formed in two major pieces, the toeholder 32 and the heelholder 34. Similarly the base 36 is in two major corresponding pieces the toebase 38 and the heelbase 40. In FIGS. 2, 3 and 4, the calfholder 42 is shown. In FIG. 4, the heelstrap 44 and the toestrap 46 are shown.

Figure 5:
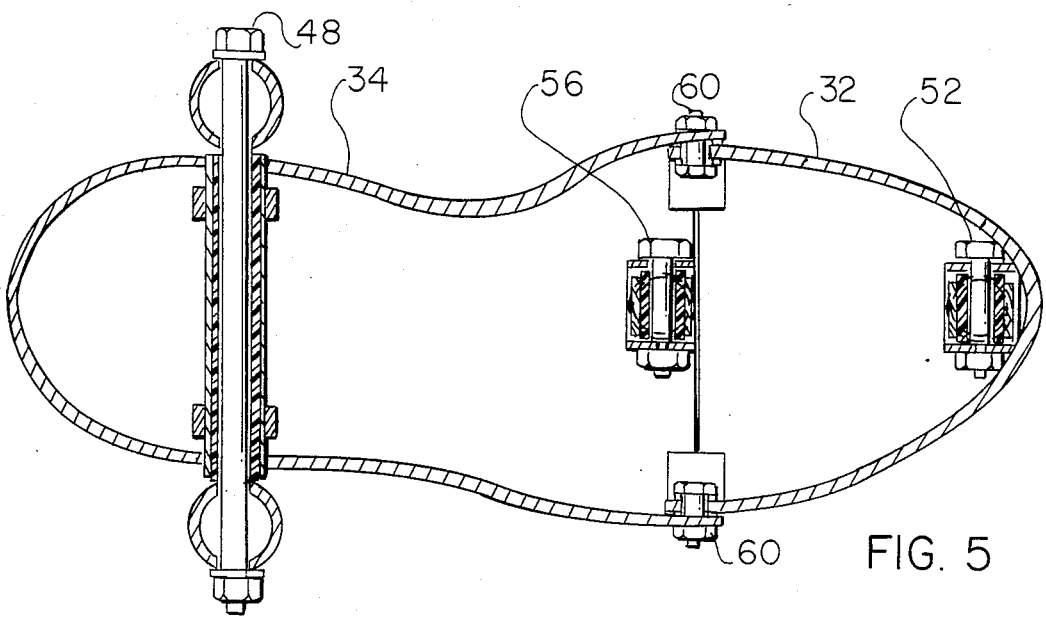
FIG. 5 shows a sectional view along the line 5—5 in FIG. 2.
Figure 6:
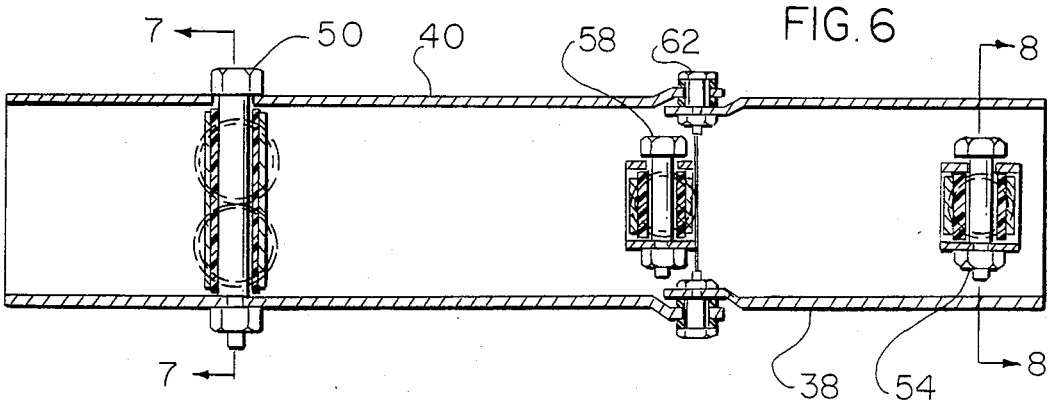
FIG. 6 shows a sectional view along the line 6—6 in FIG. 2.
Figure 7:
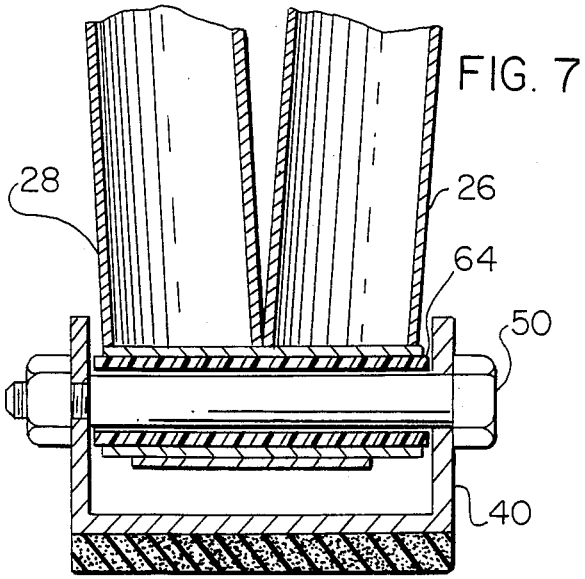
FIG. 7 shows a sectional view along the line 7—7 in FIG. 6.
Figure 8:
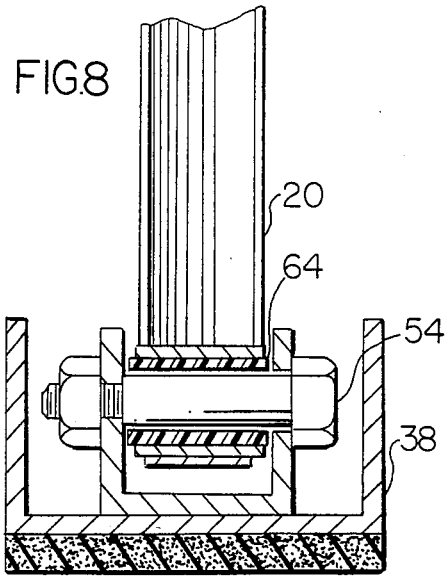
FIG. 8 shows a sectional view along the line 8—8 in FIG. 6.

There are eight hinges which can be best seen in FIGS. 5 and 6. The heelholder 34 is pointed to the heelcolumn 24 at the heelholder hinge 48. The heelbase 40 is joined to the heelcolumn 24 at the heelbase hinge 50. The toeholder 32 is joined to the toecolumn 20 at the toeholder hinge 52. The toebase 38 is joined to the toecolumn 20 at the toebase hinge 54. The heelholder 34 is joined to the solecolumn 22 at the soletop hinge 56. The heelbase 40 is joined to the solecolumn 22 at the solebottom hinge 58. The toeholder 32 is joined to the heelholder 34 at the centerholder hinge 60. The toebase 38 is joined to the heelbase 40 at the centerbase hinge 62.

The axes of heelbase hinge 50, the heelholder hinge 48, the soletop hinge 56, and the solebottom hinge 58 when viewed from the side define a four-sided figure, which for best articulation must be a parallelogram. To be explicit, the length from the heelbase hinge 50 to the heelholder hinge 48 must be equal to the length from the soletop hinge 56 to the solebottom hinge 58. Similarly the distance from the heelbase hinge 50 to the solebottom hinge 58 must be the same as the distance from the heelholder hinge 48 to the soletop hinge 56. The axes of the toeholder hinge 52, toebase hinge 54, centerbase hinge 62, and centerholder hinge 60 define another four-sided figure which for best articulation must be a parallelogram. To be explicit, the distance from the toeholder hinge 52 to the toebase hinge 54 must be the same as the distance from the centerbase hinge 62 to the centerholder hinge 60. Similarly the distance from the toeholder 52 to the centerholder hinge 60 must be the same as the distance from the toebase hinge 54 to the centerbase hinge 62. This is not to say that these distance relationships must be maintained to a high precision. Depending on the exact nature of the hinges, a tolerance of up to about a quarter inch can be allowed and still maintain good articulation, strength, and solid feel.

The heel of the heelholder 34 should be as narrow as possible for comfort to allow the V-shaped construction of the heelcolumn 24 as shown in FIG. 1 with a straight left heelcolumn 26 and straight right heelcolumn 28. The use of straight materials gives the most strength for the least weight. The left heelcolumn 26 and right heelcolumn 28 can be attached inside the heelbase 40 as shown in the Figures or outside for higher stilts and narrower heelbases 40. In an alternate embodiment the heelcolumn 24 can be made of one piece of Y-shape with the branching just below the footholder 30 and two supports on either side of the leg. The two supports on either side of the leg are important to the wearer, because beyond the strength they impart, the two supports hold the calfcollar 42 firmly giving the wearer a feeling of confidence in his support. A single support allows the calfholder 42 to be too loose or requires the wearer to tighten the calfholder 42 to the point of discomfort.

The calfholder 42 rotates for comfort as shown in FIG. 3. There are several holes in the left heelcolumn 26 and right heelcolumn 28 near the top to allow adjusting the height of the calfholder 42 for comfort. The calfholder 42 can be made quite comfortable for long hours of wear by fabricating it as a belt of cloth, plastic, leather, rubber or similar material with padding inside of softer material. An example, which works quite well, is a calfholder 42 of scuba divers weight belt padded with a piece of felt wider than the belt and about $\frac{3}{8}$ inch thick. The scuba diving belt has a quick release buckle which allows the user to quickly put the stilts on and off. The heelstrap 44 and toestrap 46 can be made of many materials with a variety of fasteners. Clamps can be used to hold a shoe as in roller skates. A specialized boot with quick release as in ski boots can also be used.

The footholder 30, and footbase 36, can be made of two pieces of material as shown in the Figures or it can be made of one piece of flexible material such as rubber or plastic with the centerholder hinge formed as a region in the footholder 34 so thin that it bends easily but thick enough to retain integrity as is conventional in the hinge art.

The materials of construction can be aluminum or magnesium tubing with aluminum or magnesium base 36 and footholder 30. The choice of materials depends on tradeoffs of strength, weight, cost and ease of fabrication. Where cost is relatively unimportant graphoepoxy can be used for the footholder, the base, and columns. Where cost is important, such as in toys, plastic can be used. Aluminum or magnesium tubing can be strengthened by filling the interior with plastic foam or using plastic inserts as appropriate. Special tubing of oval cross-section can be used to improve strength.

A bushing 64 aids in the fabrication of the hinge. The hinge should be sufficiently tight so that no twisting is possible. The bushing material should be a firm shock absorbing material. Brass or vinyl are not suitable for the bushings since these materials, can shatter. An example of bushing material suitable for manufacturing to modest tolerances would be nylon. A more shock absorbing material such as rubber is suitable as the tolerances are allowed to be greater.

The footplate and the base should be the same length as the foot in order to place the hinges at the natural places. The toebase 38, heelbase 40, toeholder 32 and heelholder 34 can be made adjustable in length using the conventional art of adjustable clamp-on roller skates. The toecolumn 20 should be as far forward as possible. The heelcolumn 24 should be directly under the wearers heel.

One model using aluminum base 36 and footholder 30, uses $1\frac{1}{4}$ inch ribbed aluminum tubing (as manufactured for ladder rungs) for the left heelcolumn 26 and right heelcolumn 28. Aluminum tubing of seven eighths inch O.D. is used for the toecolumn 20 and solecolumn 22. For a total lift of 25 inches, the total weight of each stilt is about 5.5 pounds. This model can support about two tons, well within requirements of government regulations. The weight for a comparable size model could probably be reduced to about 4 pounds with the use of graphoepoxy for the columns.

For toe-articulated stilts to be used on a hard surface, it is important to use a sole of rubber on the base 36 to prevent slipping. Toe-articulated stilts used on soft ground can include cleats or an enlarged base 36 as is suitable to the application.

Figure 9:
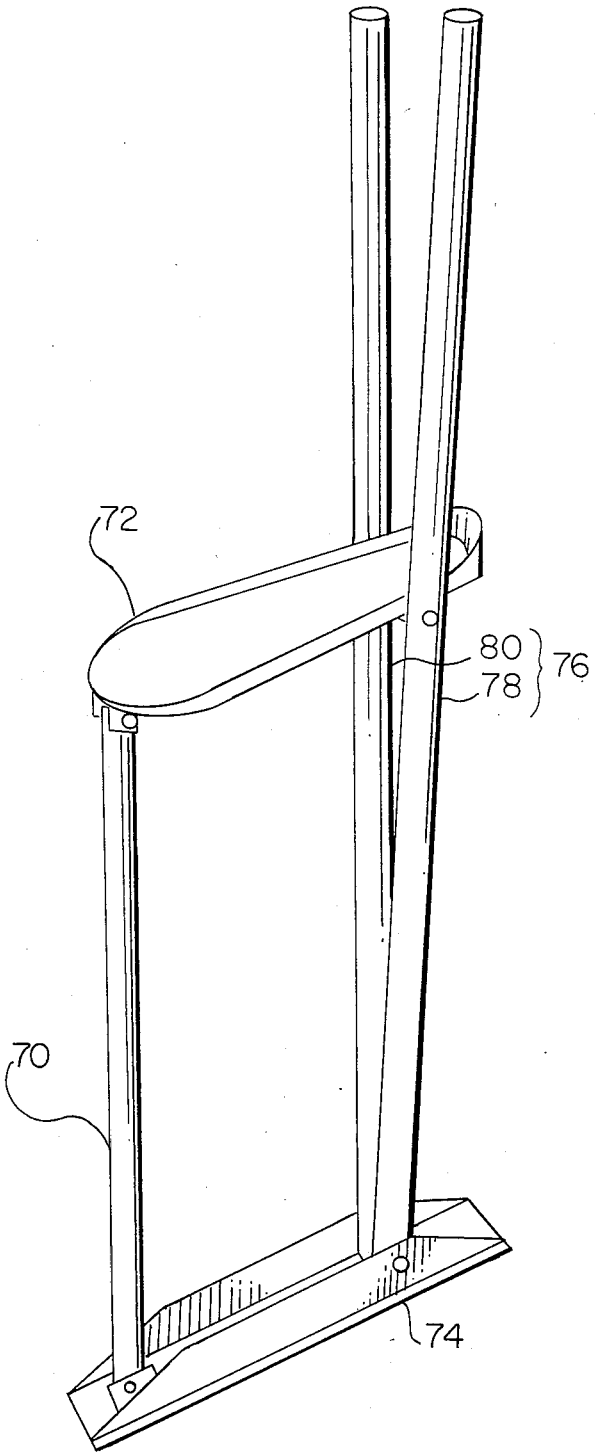
FIG. 9 shows a quarter-front view of an alternate embodiment.

In an alternate embodiment, the hinges at the center of the footholder, the hinges at the center of the base, and the solecolumn can be eliminated. This embodiment is less natural in feel and is not as suitable for dancing, acrobatics etc., but would be useful in reducing the number of parts and manufacturing costs. It would be adequate for undemanding work. This alternate embodiment is shown in FIG. 9.

The toecolumn 70 is hinged to the footholder 72 at one end and to the base 74 at the other end. The heelcolumn 76 can be made of a left heelcolumn 78 and right heelcolumn 80 as shown. It can be formed as a Y-shaped member as described previously. Toe fasteners, heel fasteners, and calfholder can be as previously described.

The toe-articulated embodiment works best if the hinge points define two parallelograms. However, individual tastes in the height of the heel or toe might require that the configuration for an individual be slightly trapezoidal with a particular shoe. Trapezoidal configurations can operate but are more uncomfortable to most wearers the more the trapezoid deviates from a parallelogram.

Embodiments incorporating shock absorbers can be used, but these involve trade-offs in weight. What is gained in shock absorbing is lost in lightness. Any shock absorbing features must not compromise the solid feel of the hinges or allow twisting. Twisting reduces control, causes loss of confidence and reduces safety.

This invention is not limited to the preferred embodiments and alternatives heretofore described, to which variations and improvements may be made, consisting of mechanically equivalent modifications to component parts without leaving the scope of the present patent, the characteristics of which are summarized in the following claims.

What is claimed is:

1. A toe-articulated stilt comprising:

a toeholder means, a heelholder means hinged with a first hinge means to said toeholder means such that the combination of said toeholder means and said heelholder means fit the sole of the foot of the wearer when said stilt is worn;

a heelbase means;

a toebase means hinged with a second hinge means to said heelbase means;

a toecolumn, one end of which is hinged with a a third hinge means to the forward end of said toeholder means, the other end of which is hinged with a fourth hinge means to the forward end of said toebase means;

a solecolumn, one end of which is hinged with a fifth hinge means to the forward end of said heelholder means, the other end of which is hinged with a sixth hinge means to the forward end of said heelbase means;

a heelcolumn, one end of which is hinged with a seventh hinge means to the rear end of said heelbase means, the other end of which is hinged with an eighth hinge means attached between said heelcolumn means and the rear end of said heelholder means wherein the eighth hinge means is located substantially level with the heel of the foot of the wearer.

2. A toe-articulated stilt as in claim 1 where said heelcolumn includes a left heelcolumn and a right heelcolumn.

3. A toe-articulated stilt as in claim 2 further comprising means for securing the top end of the right and left heelcolumns to the wearer's leg when the stilt is worn.

4. A toe-articulated stilt as in claim 3 where said means for securing the top end of the heelcolumn to the wearer's leg when said stilt is worn is a strap pivotally attached to said right heelcolumn and said left heelcolumn.

5. A toe-articulated stilt as in claim 1 wherein the distance between the third hinge means and the fourth hinge means, the distance between the fifth hinge means and the sixth hinge means, and the distance between the seventh hinge means and the eighth hinge means are equal.

6. A toe-articulated stilt as in claim 5 wherein the distance between the first and second hinge means is equal to the distance between the fifth and sixth hinge means.

7. A toe-articulated stilt as in claim 6 wherein the distance between the first and third hinge means is equal to the distance between the second and fourth hinge means.

8. A toe-articulated stilt as in claim 7 wherein the distance between the first and eighth hinge means is equal to the distance between the second and seventh hinge means.

9. A toe-articulated stilt as in claim 8 wherein the toecolumn, solecolumn, and heelcolumn are of equal length.

10. A toe-articulated stilt comprising:

a toeholder means;

a heelholder means with a first hinge means to said toeholder means such that the combination of said toeholder means and said heelholder means fit the sole of the foot of the wearer when said stilt is worn;

a heelbase means;

a toebase means, hinged with a second hinge means to the heelbase means;

a toecolumn, one end of which is hinged by a third hinge means to the forward end of the toeholder means, the other end of which is hinged by a fourth hinge means to the forward end of the toebase means;

a solecolumn, one end of which is hinged by a fifth hinge means to the forward end of the heelholder means, the other end of which is hinged by a sixth hinge means to the forward end of the heelbase means;

a heelcolumn, one end of which is hinged by a seventh hinge means to the rear end of the heelbase means, the other end of which is hinged by an eighth hinge means to the rear end of the heelholder means; whereby the distance between the third and fourth hinge means, the distance between the fifth and sixth hinge means, and the distance between the seventh and eighth hinge means are equal.

11. A toe-articulated stilt as in claim 10 wherein the distance between the first and third hinge means is equal to the distance between the second and fourth hinge means.

12. A toe-articulated stilt as in claim 11 wherein the distance between the first and eighth hinge means is equal to the distance between the second and seventh hinge means.

13. A toe-articulated stilt as in claim 12 wherein the toecolumn, the solecolumn and the heelcolumn are of equal length.

* * * * *